US007656384B2

(12) United States Patent
Saito

(10) Patent No.: US 7,656,384 B2
(45) Date of Patent: Feb. 2, 2010

(54) DRIVING DEVICE AND DRIVING METHOD OF ELECTROPHORETIC DISPLAY

(75) Inventor: Hidetoshi Saito, Suwa (JP)

(73) Assignee: Seiko Epson Corporation (JP)

( * ) Notice: Subject to any disclaimer, the term of this patent is extended or adjusted under 35 U.S.C. 154(b) by 563 days.

(21) Appl. No.: 11/619,654

(22) Filed: Jan. 4, 2007

(65) Prior Publication Data

US 2007/0171187 A1 Jul. 26, 2007

(30) Foreign Application Priority Data

Jan. 20, 2006 (JP) ..... 2006-012604

(51) Int. Cl.
*G09G 3/34* (2006.01)

(52) U.S. Cl. ..... 345/107; 345/204

(58) Field of Classification Search ..... 345/88–100, 345/107, 204; 359/296; 430/32
See application file for complete search history.

(56) References Cited

U.S. PATENT DOCUMENTS 5,582,700 A * 12/1996 Bryning et al. ..... 204/450
2006/0290649 A1* 12/2006 Johnson et al. ..... 345/107
2007/0057905 A1* 3/2007 Johnson et al. ..... 345/107
2008/0122783 A1* 5/2008 Jung et al. ..... 345/107
2008/0143700 A1* 6/2008 Shin et al. ..... 345/208

FOREIGN PATENT DOCUMENTS

JP 52-70791 A 6/1977

* cited by examiner

*Primary Examiner*—Nitin Patel
(74) *Attorney, Agent, or Firm*—Harness, Dickey & Pierce, P.L.C.

(57) ABSTRACT

A driving device of an electrophoretic display panel having a common electrode and a plurality of divided electrodes disposed opposite to the common electrode includes: a first driving circuit that outputs a plurality of voltages corresponding to a plurality of voltage data supplied as a series of data and supplies the plurality of voltages to the plurality of divided electrodes; and a second driving circuit that outputs a voltage corresponding to supplied data and supplies the voltage to the common electrode.

7 Claims, 11 Drawing Sheets

DRIVING DEVICE AND DRIVING METHOD OF ELECTROPHORETIC DISPLAY

BACKGROUND

1. Technical Field

The present invention relates to a driving device of an electrophoretic display (EPD) and an improved driving method thereof.

2. Related Art

An electrophoretic apparatus includes an electrophoretic display panel in which display corresponding to a plurality of divided electrodes (segment electrodes) driven by moving electrophoretic particles, which are contained in insulating liquid existing between a transparent common electrode and the divided electrodes disposed opposite to the common electrode, by application of a voltage between the common electrode and the divided electrodes is performed. Furthermore, in order to operate the electrophoretic display panel, the electrophoretic apparatus includes a driving device that drives the common electrode and each of the segment electrodes in correspondence with information to be displayed. The driving device includes a data holding circuit, which holds a plurality of information items used to set voltages of the common electrode and the segment electrodes, and a driving circuit that drives the common electrode and the segment electrodes in correspondence with the information held in the data holding circuit.

In the electrophoretic apparatus, colored electrophoretic particles move to either a common electrode or segment electrodes, thereby performing display. Accordingly, it generally takes a time until the movement of the electrophoretic particles is completed after a voltage is applied to the segment electrodes. For this reason, since the responsiveness is not good, the electrophoretic apparatus is mainly used for display of a still image. A variety of improvements has been suggested to improve the responsiveness.

For example, JP-A-52-70791 discloses an example in which a study on control of application of a voltage to a common electrode and each segment electrode is made to shorten the response (movement) time of electrophoretic particles in an electrophoretic display that uses a common electrode and a plurality of segment electrodes used to display a character, a numeral, a symbol, or a picture.

As mentioned above, in order to drive an electrophoretic display panel, voltage data applied to the common electrode and each segment electrode should be supplied as display data to the data holding circuit for the common electrode and each segment electrode. For example, the display data is supplied from an external computer to a serial input interface of a driving device. In the case of performing serial transmission of display data to a driving device, in order to change a voltage level of either a common electrode or a plurality of segment electrodes, all data of the common electrode and the segment electrodes should be transmitted to update all data held in a display information holding circuit.

However, as will be described later, the inventor has found out that the movement of electrophoretic particles, of which positions are to be changed, can be promoted by inverting only a voltage level of a common electrode at proper periods without changing a voltage of each segment electrode.

Even in the case of performing control in such an operation state, in the driving device described above, the entire display data of the common electrode and all segment electrodes should be supplied whenever the voltage level of the common electrode is inverted.

Accordingly, even in the data transmission side (external computer side) as well as the driving circuit of the electrophoretic display panel, burden of data processing for forming serial data and useless power consumption due to the data processing prohibit the entire system including the electrophoretic display panel from operating with low power. Furthermore, since processing at the transmission side becomes complicated, it is necessary to make a circuit operate at high speed, for example, by increasing the number of operating clock cycles of a computer, which is disadvantageous in terms of cost.

SUMMARY

An advantage of some aspects of the invention is that it provides a driving device of an electrophoretic display panel capable of setting a voltage level of a common electrode separately from setting of a voltage of each segment electrode.

Further, another advantage of some aspects of the invention is that it provides a driving method of an electrophoretic display panel in which setting of a voltage level of a common electrode can be made separately from setting of a voltage of each segment electrode.

According to an aspect of the invention, a driving device of an electrophoretic display panel having a common electrode and a plurality of divided electrodes disposed opposite to the common electrode includes: a first driving circuit that outputs a plurality of voltages corresponding to a plurality of voltage data supplied as a series of data and supplies the plurality of voltages to the plurality of divided electrodes; and a second driving circuit that outputs a voltage corresponding to supplied data and supplies the voltage to the common electrode.

With the configuration described above, it is possible to provide a path, which is used to transmit display data to a common electrode, separately from a serial interface. Due to the transmission on the separate path, it is not necessary to transmit display data of divided electrodes at the same time in the case when only a voltage level of the common electrode needs to be changed. As a result, the power consumption of circuits at transmission and driving sides is reduced, which enables low power consumption of the entire system. In addition, since an amount of data processing for obtaining serial data at the transmission side is reduced, a processing circuit can operate at low speed, which is advantageous in terms of cost.

In the driving device of the electrophoretic display panel, preferably, the first driving circuit includes a series-to-parallel data conversion circuit serving to convert supplied serial data to parallel data and a plurality of voltage output circuits serving to generate voltages of levels corresponding to a plurality of data converted to the parallel data, and the second driving circuit includes a voltage output circuit serving to generate a voltage of a level corresponding to supplied data.

Furthermore, in the driving device of the electrophoretic display panel, preferably, the divided electrodes are segment electrodes used to display all or a part of display pattern or pixel electrodes arranged in a two-dimensional manner. The invention may be applied to electrophoretic display panels having various types of electrodes.

Furthermore, in the driving device of the electrophoretic display panel, preferably, the second driving circuit inverts a voltage applied to the common electrode in correspondence with the supplied data a plural number of times. Thus, it is possible to promote the movement of electrophoretic particles.

Furthermore, in the driving device of the electrophoretic display panel, preferably, the series-to-parallel data conversion circuit includes a shift register stage and a latch stage.

Furthermore, in the driving device of the electrophoretic display panel, preferably, the voltage output circuit is a ternary output circuit that outputs one of high impedance, high voltage level, and low voltage level in response to an input. Thus, it is possible to supply a high-level or low-level voltage output to an electrode. In addition, it is possible to prevent a leak current from flowing from an electrode side to an output circuit in a non-voltage-output state.

In addition, according to another aspect of the invention, a method of driving an electrophoretic display panel having a common electrode and a plurality of divided electrodes disposed opposite to the common electrode includes: outputting a plurality of voltages corresponding to a plurality of voltage data supplied as a series of data and supplying the plurality of voltages to the plurality of divided electrodes; and outputting a voltage corresponding to supplied data and supplying the voltage to the common electrode.

With the configuration described above, it is possible to separate a path, which is used to transmit display data to a common electrode, from a serial interface. Due to the transmission on the separate path, it is not necessary to transmit display data of divided electrodes at the same time in the case when only a voltage level of the common electrode needs to be changed. As a result, the power consumption of circuits at transmission and driving sides is reduced, which enables low power consumption of the entire system. In addition, since an amount of data processing for forming serial data at the transmission side is reduced, a processing circuit can operate at low speed, which is advantageous in terms of cost.

BRIEF DESCRIPTION OF THE DRAWINGS

The invention will be described with reference to the accompanying drawings, wherein like numbers reference like elements, and wherein.

DESCRIPTION OF EXEMPLARY EMBODIMENTS

Hereinafter, embodiments of the invention will be described with reference to the accompanying drawings.

First, the configuration of an electrophoretic display and voltage pattern generated in a common electrode and each segment electrode will be described.

Figure 1A:
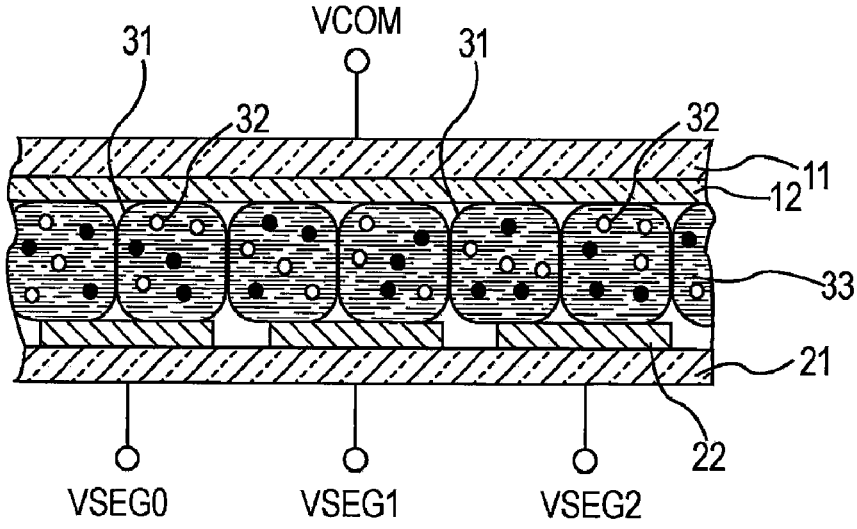
FIG. 1A is a view explaining an electrophoretic display panel.

FIG. 1A is an explanatory view schematically illustrating an electrophoretic display panel. As shown in FIG. 1A, a transparent electrode 12, such as ITO (indium tin oxide), is formed on a first transparent substrate 11 formed of, for example, glass and plastic. A second substrate 21 formed of, for example, glass and plastic is disposed opposite to the substrate 11. On the substrate 21, a plurality of segment electrodes 22 are formed so as to be opposite to the common electrode 12. Between the plurality of segment electrodes 22 and the common electrode 12, a plurality of microcapsules 31 each of which has electrophoretic particles 32 and insulating liquid 33 sealed therein are disposed. In this example, white particles that are positively charged and black particles that are negatively charged exist as the electrophoretic particles 32.

If a positive high level HVDD is applied to the segment electrodes 22, negative black particles gather at the side of the segment electrodes 22 and positive white particles gather at the side of the common electrode 12. Accordingly, as viewed from the side of the common electrode 12, the corresponding segments are white displayed. In addition, if a low level VSS is applied to the segment electrode 22, positive white particles gather at the side of the segment electrodes 22 and negative black particles gather at the side of the common electrode 12. Accordingly, as viewed from the side of the common electrode 12, the corresponding segments are black displayed.

For example, seventy-nine segment electrodes VSEG0 to VSEG78 and an electrode 80 serving as a common electrode VCOM are used as segment electrodes of a watch that displays date (year/month/day), day of the week, AM, PM, hour and minute, and the like.

Figure 1B:
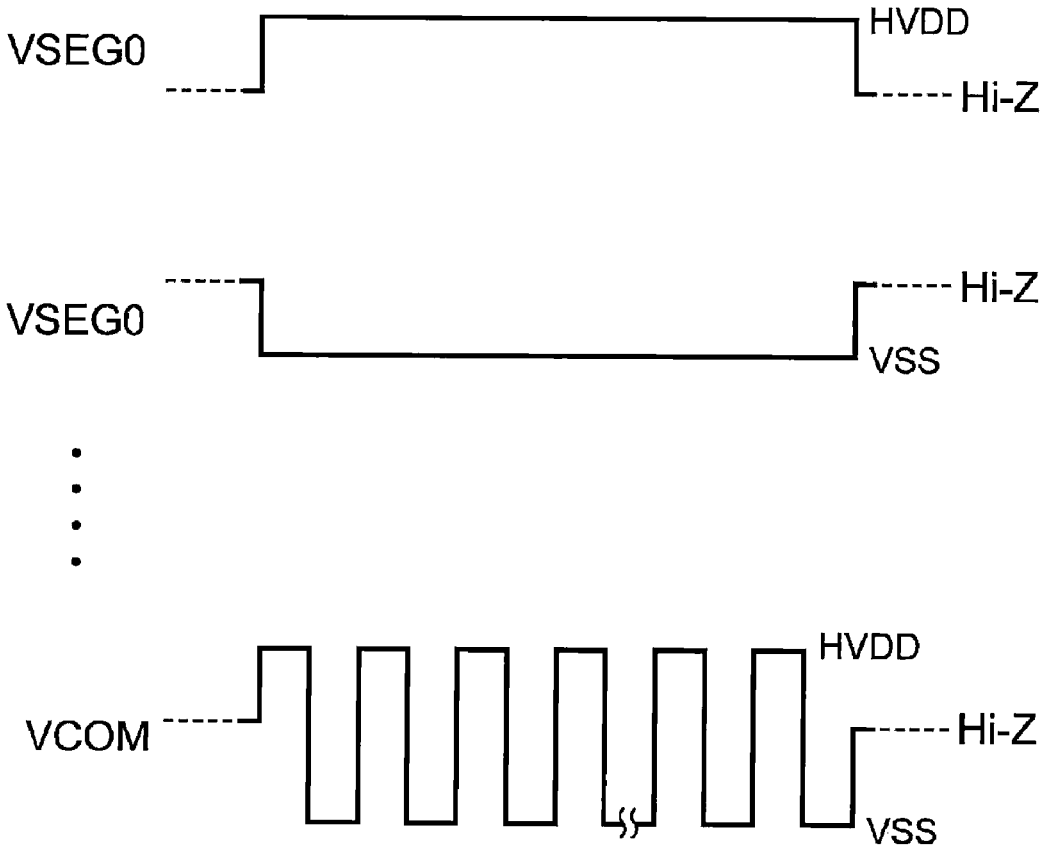
FIG. 1B is a view explaining an example in which a voltage is applied to segment electrodes and a common electrode.

FIG. 1B illustrates an example in which a voltage is applied to segment electrodes and a common electrode. As shown in FIG. 1B, a high level HVDD is applied to the segment electrode VSEG0 so as to perform white display and a low level VSS is applied to the segment electrode VSEG1 so as to perform black display. For example, the high level HVDD of an applied voltage is 15 V and the low level VSS thereof is 0 V. Moreover, when a voltage is not applied to an electrode, the corresponding electrode is held in an electrically high impedance state (Hi-Z), and thus current leak is prevented.

At the same time as a voltage is applied to each of the segment electrodes, a driving signal inverted between the high level HVDD and the low level VSS is applied to the common electrode VCOM. The driving signal that is inverted is obtained by using five to ten consecutive pulses (periods), each of which has a low-level period of 100 mS (millisecond) and a high-level period of 100 mS, for a display period of time of the corresponding segment. By applying to the common electrode the driving signal that is inverted, movement of electrophoretic particles having not reached electrodes is promoted.

Comparative Example

Figure 2:
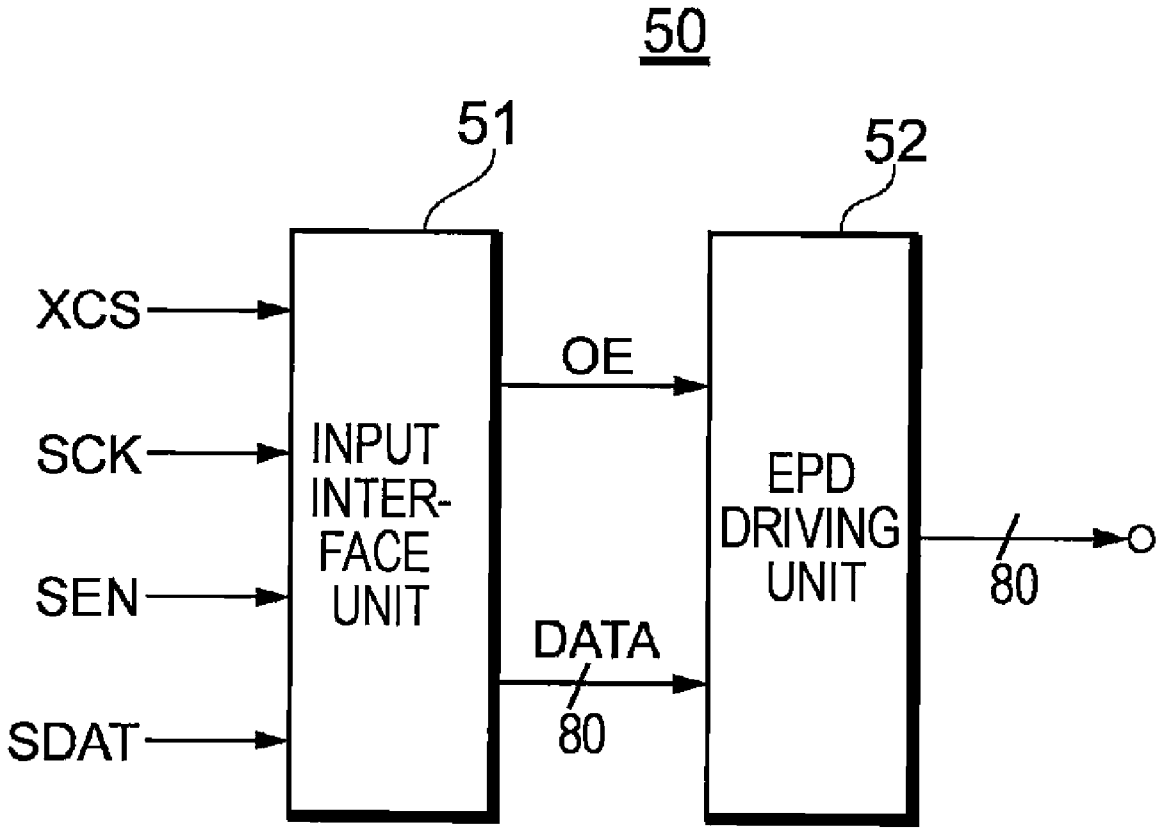
FIG. 2 is a view explaining a driving device of an electrophoretic display panel in a comparative example.
Figure 3:
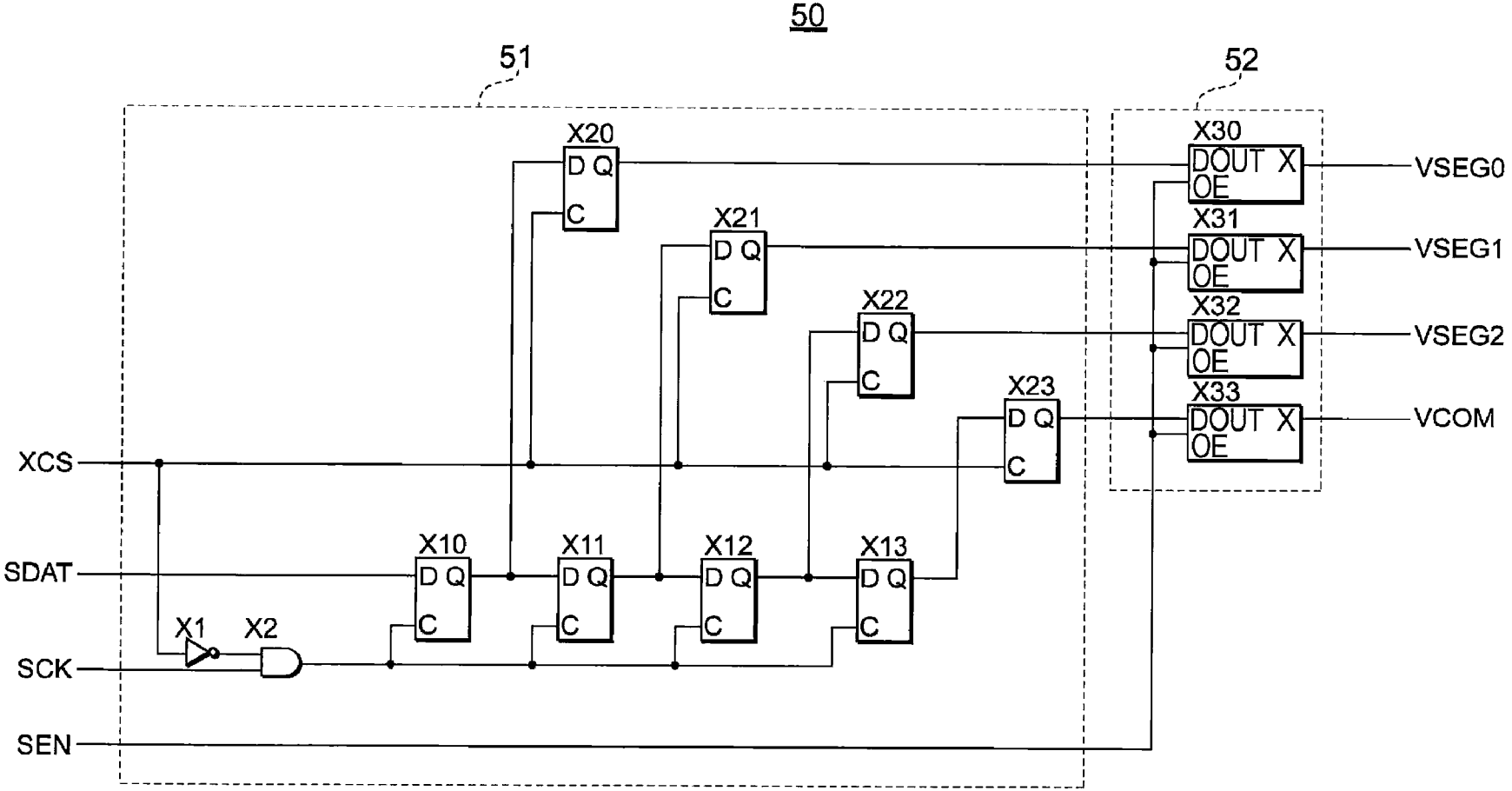
FIG. 3 is a circuit diagram illustrating an example of the configuration of an input interface unit and an EPD driving unit of a driving device.
Figure 4:
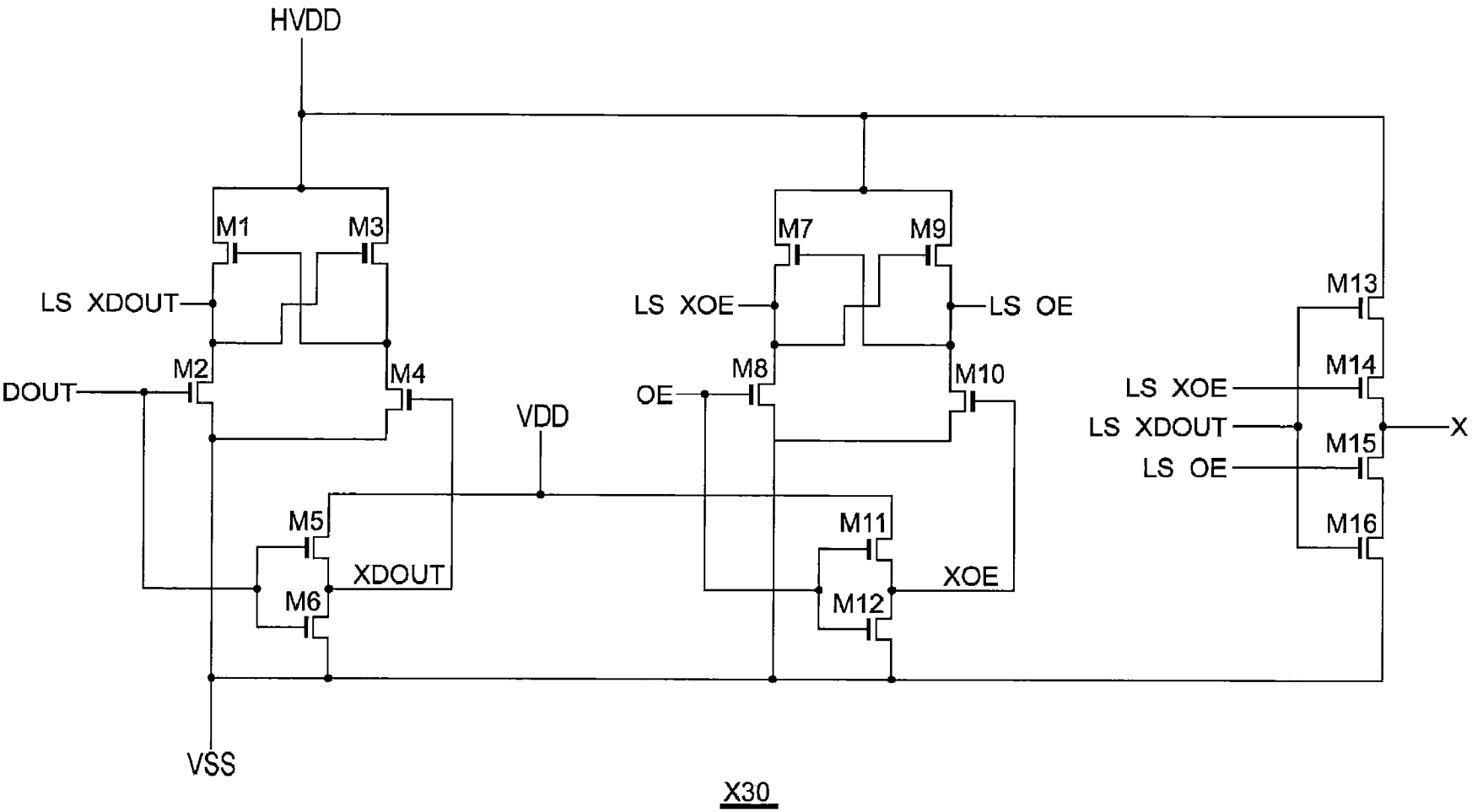
FIG. 4 is a circuit diagram illustrating an example of the configuration of a ternary output circuit.

FIGS. 2 to 4 illustrate a comparative example for making the invention easily understood. In the comparative example, a serial input interface of a driving device of an electrophoretic display panel is used to realize the state of application of a voltage to each electrode shown in FIG. 1B.

FIG. 2 is a block diagram illustrating a driving device of an electrophoretic display panel, and a driving device 50 includes an input interface unit 51 and an EPD (electrophoretic display panel) driving unit 52. In addition, the driving device 50 is formed by using an integrated circuit. In addition, although not particularly shown, the driving device 50 includes an oscillator serving to generate a clock signal used thereinside, a DC-DC converter serving to raise a low voltage output LVDD (for example, 3 V) of a battery to a voltage level HVDD (15 V) for driving the electrode in response to a command.

The input interface unit 51 converts serial data SDAT including a series of voltage data (eighty data items), which is supplied from an external computer (not shown) and is to be set for each segment electrode and the common electrode, to parallel data by using a shift register and holds voltage data of respective electrodes in eighty data latches.

The input interface unit 51 performs a serial-to-parallel conversion process on the serial data SDAT by using an XCS signal indicating a data supply period of time and an SCK signal that is a data transmission clock. In addition, when the input interface unit 51 receives an SEN signal, which commands an output, from an external computer, the input interface unit 51 outputs an OE signal to the EPD driving unit 52.

In the EPD driving unit 52, one driving output system includes a level shifter and a three-output-state inverter. In addition, the EPD driving unit 52 outputs a voltage, which corresponds to voltage data held in each latch, to each of the eighty electrodes (each of the segment electrodes and the common electrode) in response to an OE signal.

FIG. 3 is a circuit diagram illustrating an example of the configuration of the driving device 50 of an electrophoretic display panel. In the example of the configuration, a circuit of processing four data of eighty serial data is shown.

Referring to FIG. 3, a shift register includes D flip-flops (latches) X10 to X13 connected in series to each other. Serial data SDAT is supplied to a data input terminal D of the first-stage D flip-flop X10, and a transmission clock SCK signal is supplied to each clock input terminal C of each of the D flip-flops X10 to X13, which are located at the respective stages, through an AND gate X2. A Q output of each of the D flip-flops X10 to X13 is input to a next-stage input terminal. In addition, the Q outputs of the D flip-flops X10 to X13 are respectively supplied to input terminals of latches X20 to X23. The latches X20 to X23 are input with the Q outputs of the latches X10 to X13, respectively, in response to an XCS signal supplied to clock input terminals C of the latches X20 to X23. Moreover, the XCS signal is input to the AND gate X2 through an inverter X1 and serves to regulate transmission of the clock SCK signal. Then, a data latch operation is performed after a data shift period of time of serial data has elapsed. The logic gates X1 and X2, the D flip-flops X10 to X13, and the latches X20 to X23 form the input interface unit 51.

The Q outputs of the latches X20 to X23 are supplied to DOUT input terminals of ternary (tri-state) output circuits X30 to X33, respectively. Moreover, the SEN signal which commands an output is supplied as an OE signal to an OE input terminal of each of the ternary output circuits X30 to X33. In the case when the OE signal corresponds to a non-output command, each of the ternary output circuits X30 to X33 causes an output terminal thereof to be in a high impedance (Hi-Z) state. In the case when the OE signal is in a state of an output command, a high level signal HVDD (15 V) is output if an output of a preceding-stage latch is LVDD (3 V). If an output of the preceding-stage latch is VSS (0 V), a low level signal VSS (0 V) is output.

FIG. 4 illustrates an example of the configuration of a ternary output circuit. Since a high power supply voltage HVDD is controlled by a MOS transistor, the ternary output circuit X30 raises a signal voltage of 3 V to a signal voltage of 15 V so as to obtain a gate voltage of a MOS transistor (MOS transistor inverter).

As shown in FIG. 4, the ternary output circuit includes two level shift circuits (level shifters) and a tri-state inverter.

A first level shift circuit includes MOS transistors M1 to M6. The transistors M1, M3, and M5 are PMOS transistors, and the transistors M2, M4, and M6 are NMOS transistors. The transistors M1 and M2 are connected in series to each other between the power supply voltage HVDD and a ground potential VSS and the transistors M3 and M4 are connected in series to each other between the power supply voltage HVDD and a ground potential VSS. A gate of the transistor M1 is connected to a connection point between the transistors M3 and M4 and a gate of the transistor M3 is connected to a connection point between the transistors M1 and M2, that is, the transistors are cross-connected. The transistors M5 and M6 are connected in series between a power supply LVDD and a ground potential VSS, thereby forming an inverter.

An output of the above-described latch (for example, X20) is supplied to a gate of the transistor M2 as a DOUT signal, and at the same time, supplied to a gate of the transistor M4 as an XDOUT signal whose waveform has been inverted through the inverter including the transistors M5 and M6.

In the configuration described above, when the DOUT signal is at a low level VSS, the transistor M2 is turned off and the transistor M4 is turned on. Accordingly, since the gate of the transistor M1 is at a low level, the transistor M1 electrically conducts. As a result, an LS XDOUT output changes to the high level HVDD. Since the high level is applied to the gate of the transistor M3, the transistor M3 is turned off and the gate of the transistor M1 is maintained at a low level. On the other hand, when the DOUT signal is at the high level LVDD, the transistor M2 is turned on and the transistor M4 is turned off. Accordingly, since the gate of the transistor M3 is at a low level, the transistor M3 electrically conducts. Thus, since the high level HVDD is applied to the gate of the transistor M1, the transistor M1 is turned off and the gate of the transistor M1 is maintained at a high level. As a result, the LS XDOUT output changes to the low level VSS.

As described above, the DOUT output, which is a low-level (for example, 3 V) pulse signal, is converted to the LS XDOUT output, which is a high-level (for example, 15 V) pulse signal.

Similarly, transistors M7 to M12 form a second level shift circuit, and an LS OE signal obtained by level-shifting the OE signal and an LS XOE signal obtained by inverting the LS OE signal are obtained due to the transistors M7 to M12.

As shown in FIG. 4, the tri-state inverter is formed by connecting PMOS transistors M13 and M14 and NMOS transistors M15 and M16 in series between the power supply HVDD and the ground potential VSS. A connection point between the transistors M14 and M15 serves as an output terminal so as to be connected to a corresponding electrode. In the case of the ternary output circuit X30, the output terminal X is connected to the segment electrode VSEG0. The LS XDOUT signal is supplied to gates of the transistors M13 to M16, the LS XOE signal is supplied to a gate of the transistor M14, and the LS OE signal is supplied to a gate of the transistor M15. Therefore, when the transistors M14 and M15 do not electrically conduct due to the LS OE signal and the LS XOE signal, the output terminal X is under a high impedance state. Moreover, when the transistors M14 and M15 electrically conduct due to the LS OE signal and the LS XOE signal, the voltage VSS or HVDD which is an inverted output of the LS XDOUT is output from the output terminal X in correspondence with a level of the LS XDOUT signal. Ternary output circuits X31 to X33 are formed in the same manner.

Next, an operation of the driving device 50 described above will be described.

Figure 5:
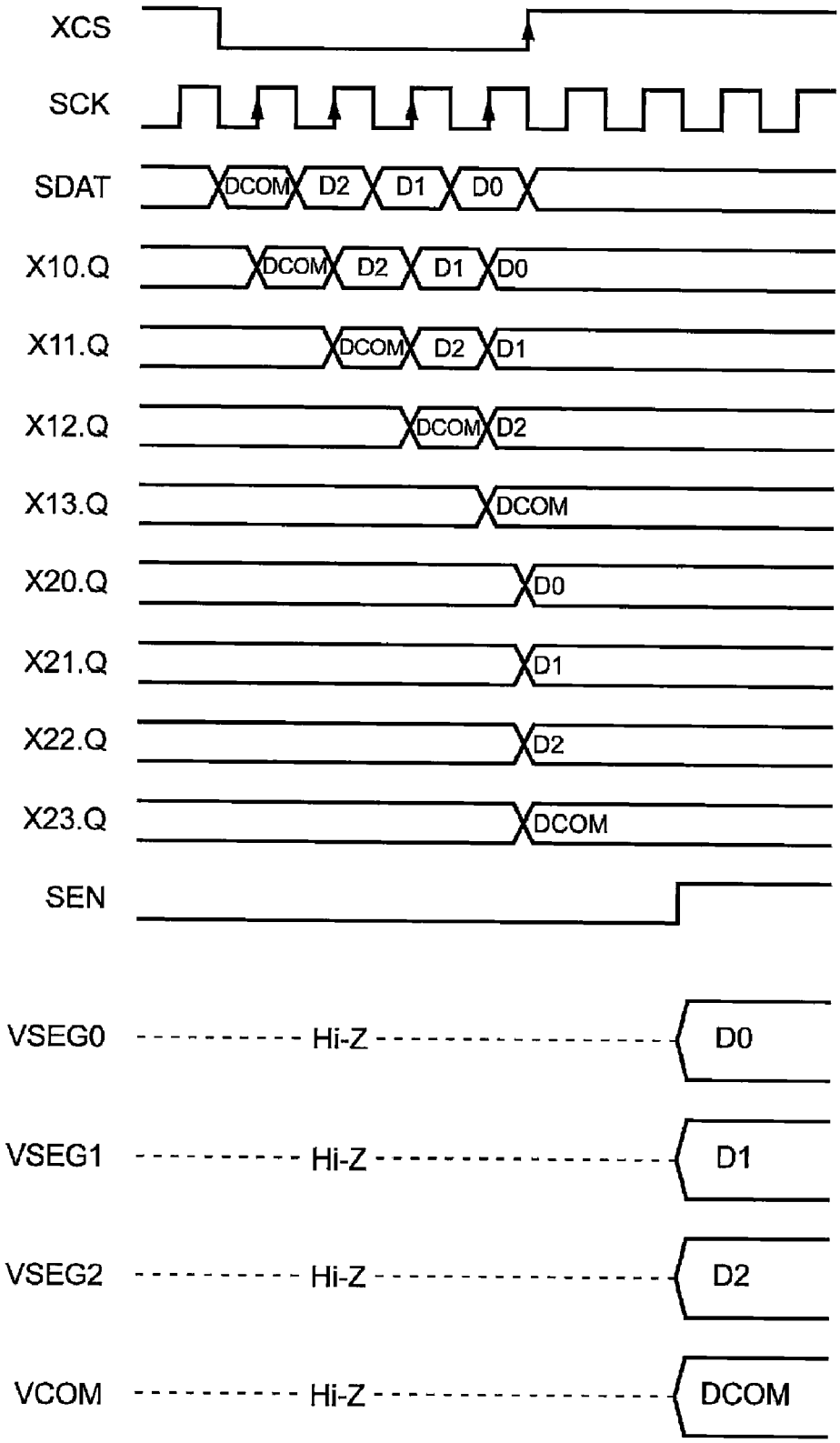
FIG. 5 is a timing chart illustrating various signals used to explain an operation in the comparative example.

FIG. 5 is a timing chart illustrating waveforms of signals of the respective parts in the example of the configuration of the driving device 50 shown in FIG. 3. In order to perform predetermined display, an external computer supplies to the driving device 50 a serial data SDAT signal associated with voltage data of each segment electrode and a common electrode, a data transmission clock XCS signal, and an XCS signal indicating an existence period of time of the serial data SDAT signal as a low level VSS.

During a period of time when the XCS signal is at a low level, an input terminal of the AND gate X2 is at a high level LVDD, and thus the transmission clock SCK signal is supplied to the shift registers X10 to X13. The serial data SDAT signal is supplied in synchronization with the transmission clock SCK signal. Each of the D flip-flops X10 to X13 sequentially shifts serial data of the SDAT signal by enabling a D input at a rising edge of the SCK signal. As described above, in the example shown in the drawing, an explanation is made by using four data, that is, voltage data D0 to D2 of segment electrodes and voltage data DCOM of the common electrode, for the convenience of explanation. In the case of eighty electrodes, shift registers located at eighty stages, voltage data D0 to D78 of segment electrodes, and voltage data DCOM of a common electrode exist.

When all serial data of the SDAT signal is transmitted and is then held in the shift registers X10 to X13, the XCS signal changes to a high level LVDD. Accordingly, Q outputs of the shift registers X10 to X13 are respectively supplied to the latches X20 to X23, such that the voltage data D0 to D2 and DCOM of the electrodes is held. The Q output of each of the latches X20 to X23 is supplied to each of the DOUT input terminals of the ternary output circuits X30 to X33.

Then, when the SEN signal supplied from the external computer changes to the high level LVDD that commands generation of an electrode voltage, the SEN signal serves as an OE (output enable) signal to activate each of the ternary output circuits X30 to X33. Thus, the ternary output circuits X30 to X33 respectively supply, to the electrodes VSEG0 to VSEG2 and VCOM, the voltage level HVDD or VSS corresponding to the Q outputs D0 to D2 and DCOM of the latches X20 to X23 under a high impedance state.

In the circuit configuration of the above comparative example, as shown in FIG. 1B, in the case of promoting the movement of electrophoretic particles by inverting a voltage applied to the common electrode VCOM, voltage data of the common electrode VCOM is changed, and accordingly, it is necessary to update voltage data of all of the electrodes.

First Embodiment

FIGS. 6 to 9 are views illustrating a first embodiment of the invention. In the drawings, components corresponding to those in FIGS. 2 to 5 are denoted by the same reference numerals, and detailed explanation thereof will be omitted.

In the present embodiment, since a voltage applied to a group of segment electrodes and a voltage applied to a common electrode can be separately set by using different routes, a voltage of the common electrode is controlled separately from that of the group of segment electrodes. For this reason, if it is not necessary to change voltage data of the group of segment electrodes, it is possible to invert a voltage of the common electrode without updating the voltage data of the group of segment electrodes.

Figure 6:
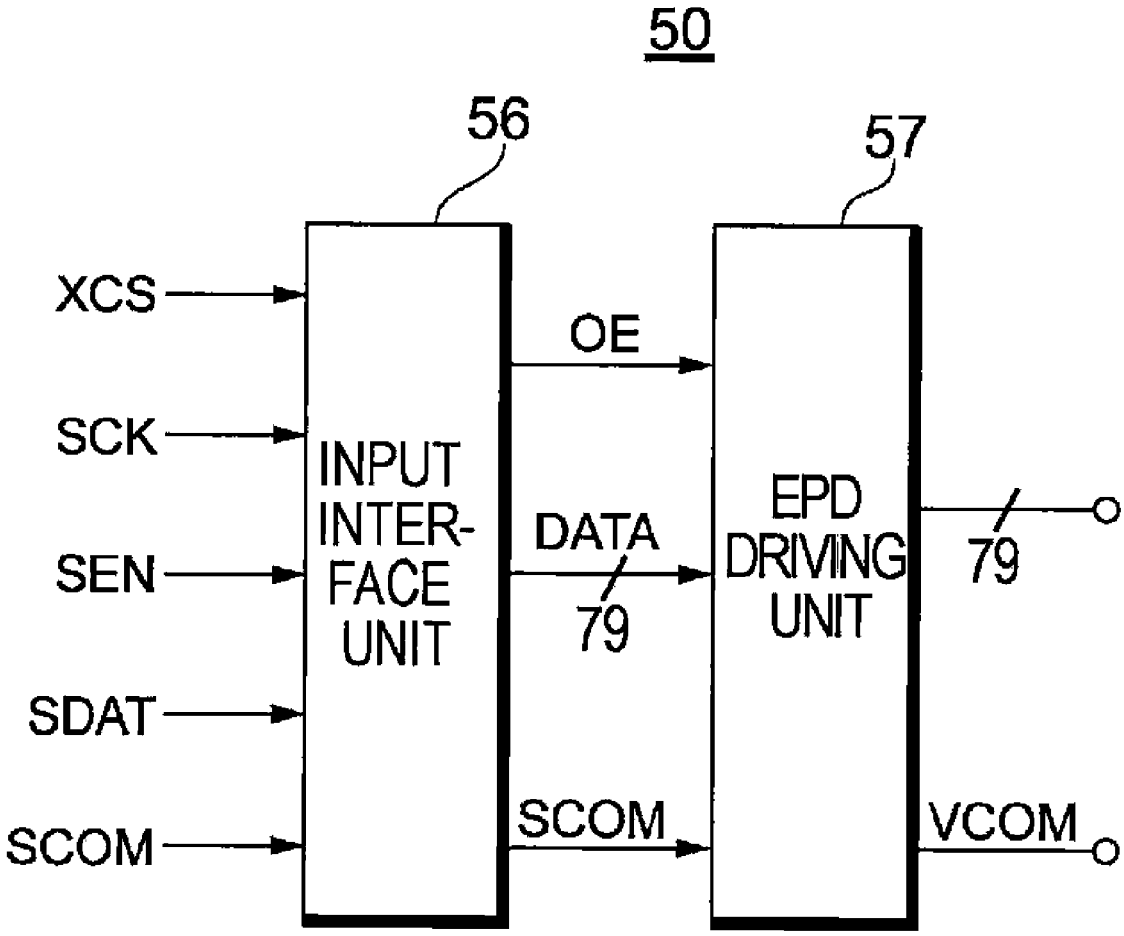
FIG. 6 is a view explaining a driving device of an electrophoretic display panel in an embodiment.

As shown in FIG. 6, a driving device 50 of an electrophoretic panel in the present embodiment includes an input interface unit 56 and an EPD driving unit 57. The XCS signal, the SCK signal, the SEN signal, and the SDAT signal, which have been described above, and a SCOM signal are supplied to the input interface unit 56 from an external computer.

In the present embodiment, the SDAT signal is associated with a series of voltage data D0 to D78 of segment electrodes (in the case when the number of segment electrodes is 79), but the voltage data DCOM of the common electrode is not included. The newly added SCOM signal is a signal used to directly set the voltage level DCOM of the common electrode from the outside.

The input interface unit 56 performs a serial-to-parallel conversion process on a series of voltage data of segment electrodes of the SDAT signal by using the XCS signal indicating the data supply period of time and the SCK signal which is a data transmission clock. In addition, when the input interface unit 56 is input with the SEN signal, the input interface unit 56 outputs an OE signal to the EPD driving unit 52.

The EPD driving unit 57 is configured in the same manner as the EPD driving unit 52. That is, one driving output system includes a level shifter and a ternary output circuit (three-output-state inverter). In addition, a voltage corresponding to voltage data held in each latch is output to each of the eighty electrodes (each segment electrode and a common electrode) in response to the OE signal.

The SCOM signal is supplied to the EPD driving unit 57 through the input interface unit 56. The EPD driving unit 57 supplies the SCOM signal to the ternary output circuit that sets a voltage applied to the common electrode VCOM and controls a voltage level of the common electrode VCOM separately from the segment electrode group.

Figure 7:
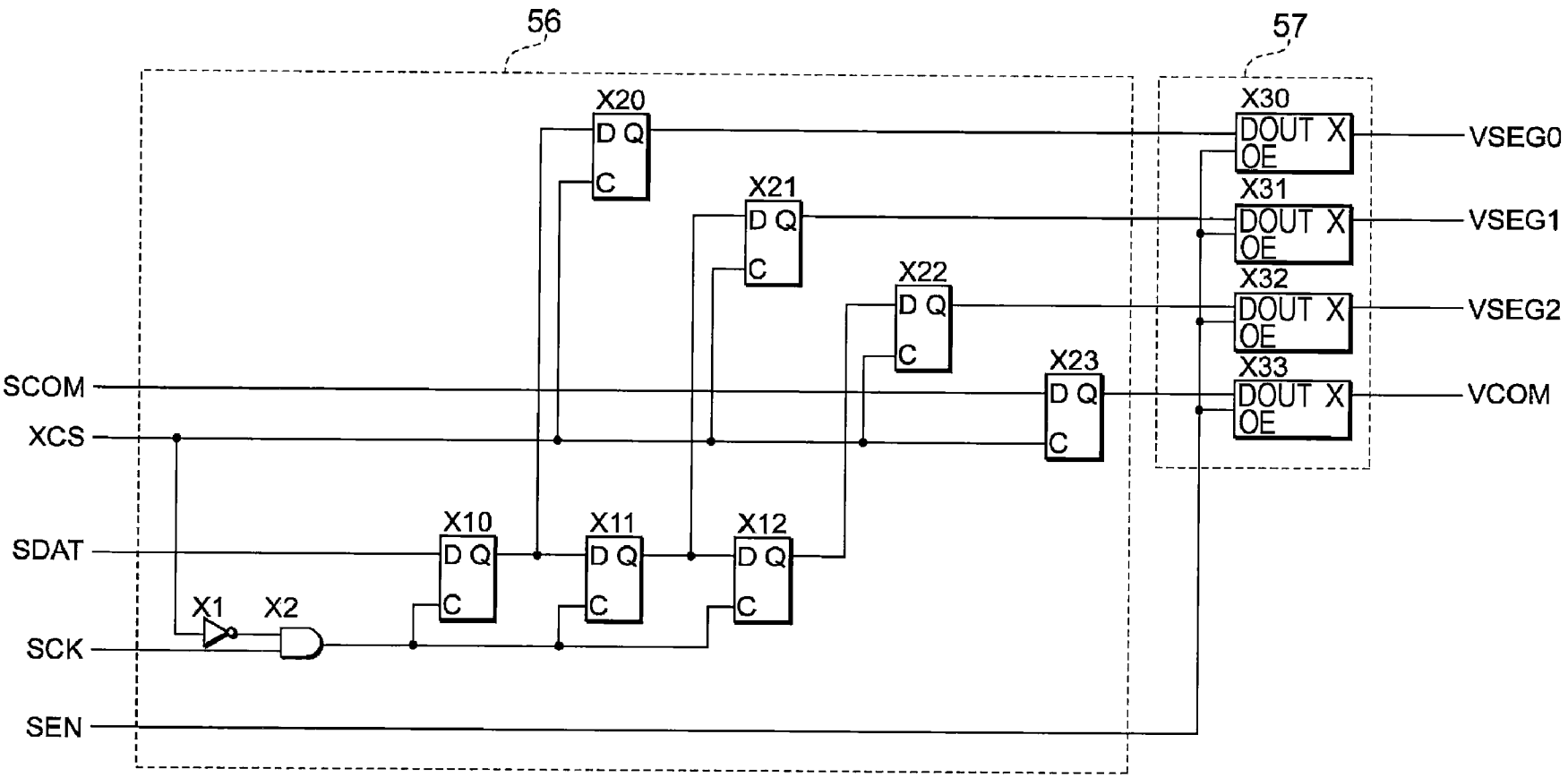
FIG. 7 is a circuit diagram illustrating an example of the configuration of an input interface unit and an EPD driving unit of a driving device according to a first embodiment.

FIG. 7 illustrates an example of a specific circuit configuration of the driving circuit 50 in the first embodiment. Referring to FIG. 7, a shift register includes D flip-flops X10 to X12. Since the voltage data DCOM of a common electrode does not exist in serial data as compared with the configuration shown in FIG. 3, the D flip-flop X13 is not necessary. In addition, the SCOM signal associated with the voltage data DCOM of the common electrode is supplied to a D input terminal of a latch X23, and the XCS signal is supplied to a C input of the latch X23. A level (at the rising edge of the XCS signal) of the SCOM signal supplied during a period of time (serial data transmission period) when the XCS signal is at a low level is supplied to the latch X23, which becomes a Q output. The Q output of the latch X23 is supplied to a DOUT input terminal of a ternary circuit X33. The other configurations are the same as those of the circuit shown in FIG. 3.

In the configuration described above, shift registers X10 to X12, latches X20 to X22, and ternary output circuits X30 to X32 form a first driving circuit. The latch X23 and the ternary output circuit X33 form a second driving circuit.

In the configuration described in the present embodiment, the voltage VCOM of a common electrode can be set separately from other segment electrodes by using the XCS signal and the SCOM signal. Furthermore, in the same manner as in the above comparative example, a voltage corresponding to voltage data of each electrode is applied to each electrode.

Figure 8:
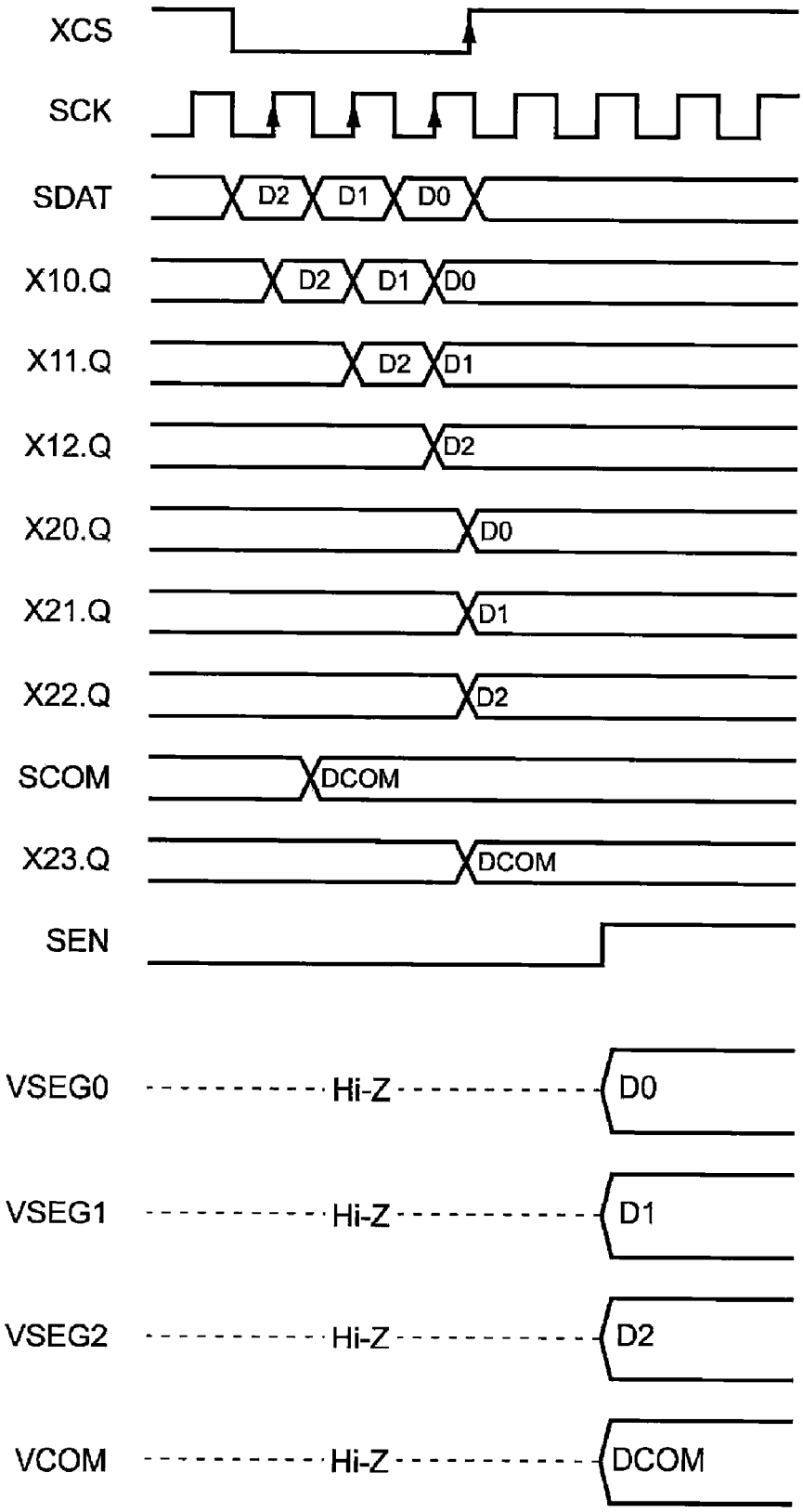
FIG. 8 is a timing chart illustrating various signals used to explain an operation in the first embodiment.

FIG. 8 is a timing chart illustrating waveforms of signals used to explain an operation of the driving circuit 50 in the first embodiment described above. In the drawing, components corresponding to those in FIG. 5 are denoted by the same reference numerals.

In order to perform predetermined display, an external computer supplies to the driving device 50 a serial data SDAT signal associated with voltage data of each segment electrode and a common electrode, a data transmission clock XCS signal, and an XCS signal indicating an existence period of time of the serial data SDAT signal as a low level VSS. Furthermore, the external computer separately supplies the SCOM signal used to set a voltage of the common electrode.

During a period of time when the XCS signal is at a low level, an input terminal of the AND gate X2 is at a high level LVDD, and thus the transmission clock SCK signal is supplied to the shift registers X10 to X12. The serial data SDAT signal is supplied in synchronization with the transmission clock SCK signal. Each of the D flip-flops X10 to X12 sequentially shifts serial data of the SDAT signal by enabling a D input at a rising edge of the SCK signal. In the example shown in the drawing, an explanation is made by using three data, that is, voltage data D0 to D2 of segment electrodes, for the convenience of explanation. Moreover, the voltage data DCOM of the common electrode is supplied separately from the serial data (SDAT signal) by using the SCOM signal. In addition, in the case when the number of segment electrodes is 79, shift registers corresponding to seventy-nine stages are provided, and voltage data D0 to D78 of segment electrodes are supplied.

When all serial data of the SDAT signal is transmitted and is then held in the shift registers X10 to X12, the XCS signal changes to a high level LVDD. Accordingly, Q outputs of the shift registers X10 to X12 are supplied to the latches X20 to X22, respectively, such that the voltage data D0 to D2 of the electrodes is held.

In addition, the voltage data of the SCOM signal is supplied to the latch X23 at a rising edge of the XCS signal and then becomes a Q output of the latch X23. Q outputs of the latches X20 to X23 are supplied to DOUT input terminals of the ternary output circuits X30 to X33, respectively.

Then, when the SEN signal supplied from the external computer changes to the high level LVDD that commands generation of an electrode voltage, the SEN signal serves as an OE (output enable) signal to activate each of the ternary output circuits X30 to X33. Thus, the ternary output circuits X30 to X33 respectively supply, to the electrodes VSEG0 to VSEG2 and VCOM, the voltage level HVDD or VSS corresponding to the Q outputs D0 to D2 and DCOM of the latches X20 to X23 under a high impedance state.

As described above, the voltage setting with respect to each electrode is made.

Figure 9:
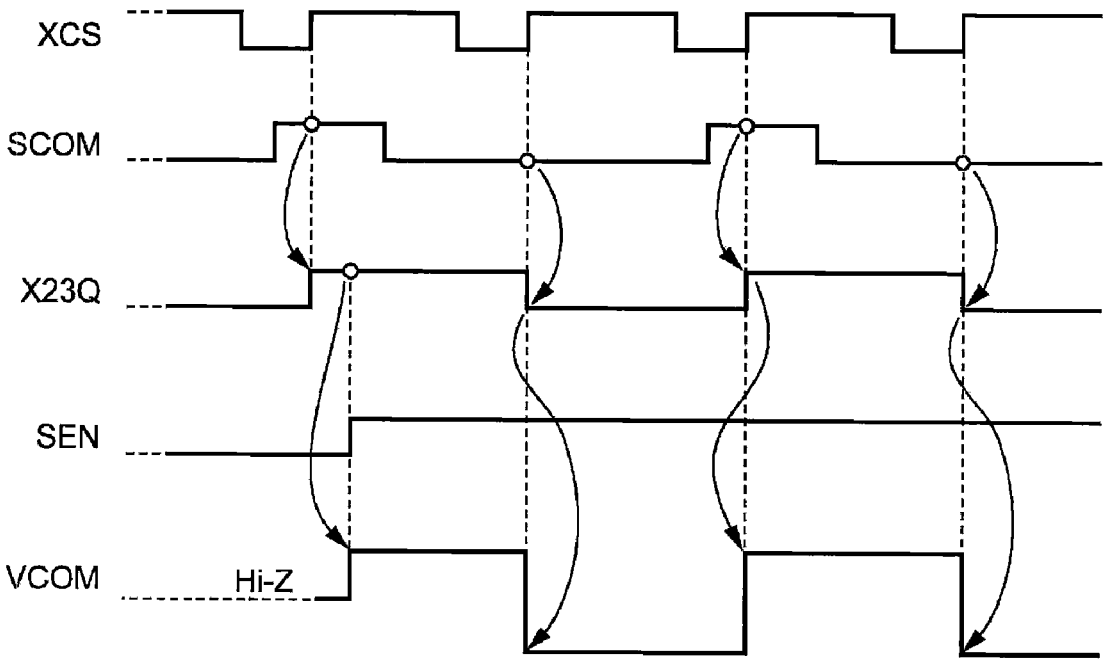
FIG. 9 is a timing chart of related signals explaining an example of setting a voltage applied to a common electrode by using an SCOM signal.

FIG. 9 is a view illustrating a signal timing chart when independently changing (inverting) a voltage of a common electrode in the circuit configuration described in the first embodiment.

After each electrode voltage has been set as described above, the external computer stops transmitting to the driving device 50 the SDAT signal associated with serial data and the SCK signal used for synchronization of data transmission.

In the case when a voltage level of the common electrode is set as a high level, the external computer sets the SCOM signal as a high level so as to initiate the XCS signal. Accordingly, the latch X23 receives the SCOM signal, which is at a high level, and holds the high-level SCOM signal as a Q output thereof. The ternary output circuit X33 is activated by the SEN signal so as to output HVDD.

In the case when a voltage level of the common electrode is set as a low level, the external computer sets the SCOM signal as a low level so as to initiate the XCS signal. Accordingly, the latch X23 receives the SCOM signal, which is at a low level, and holds the low-level SCOM signal as the Q output thereof. If the SEN signal is at a high level (in an output command state), the ternary output circuit X33 outputs the voltage VSS.

In the same manner hereinbelow, the voltage data of a common electrode is set by using the SCOM signal, and a voltage VCOM applied to the common electrode is set by acquiring the voltage data by means of the XCS signal.

As described above, according to the first embodiment, it is possible to invert (change) the voltage VCOM applied to the common electrode without transmitting voltage data of all of the segment electrodes. Therefore, the external computer does not need to perform a process of generating serial data (pre-process) whose purpose is to only invert a voltage applied to the common electrode.

Second Embodiment

Figure 10:
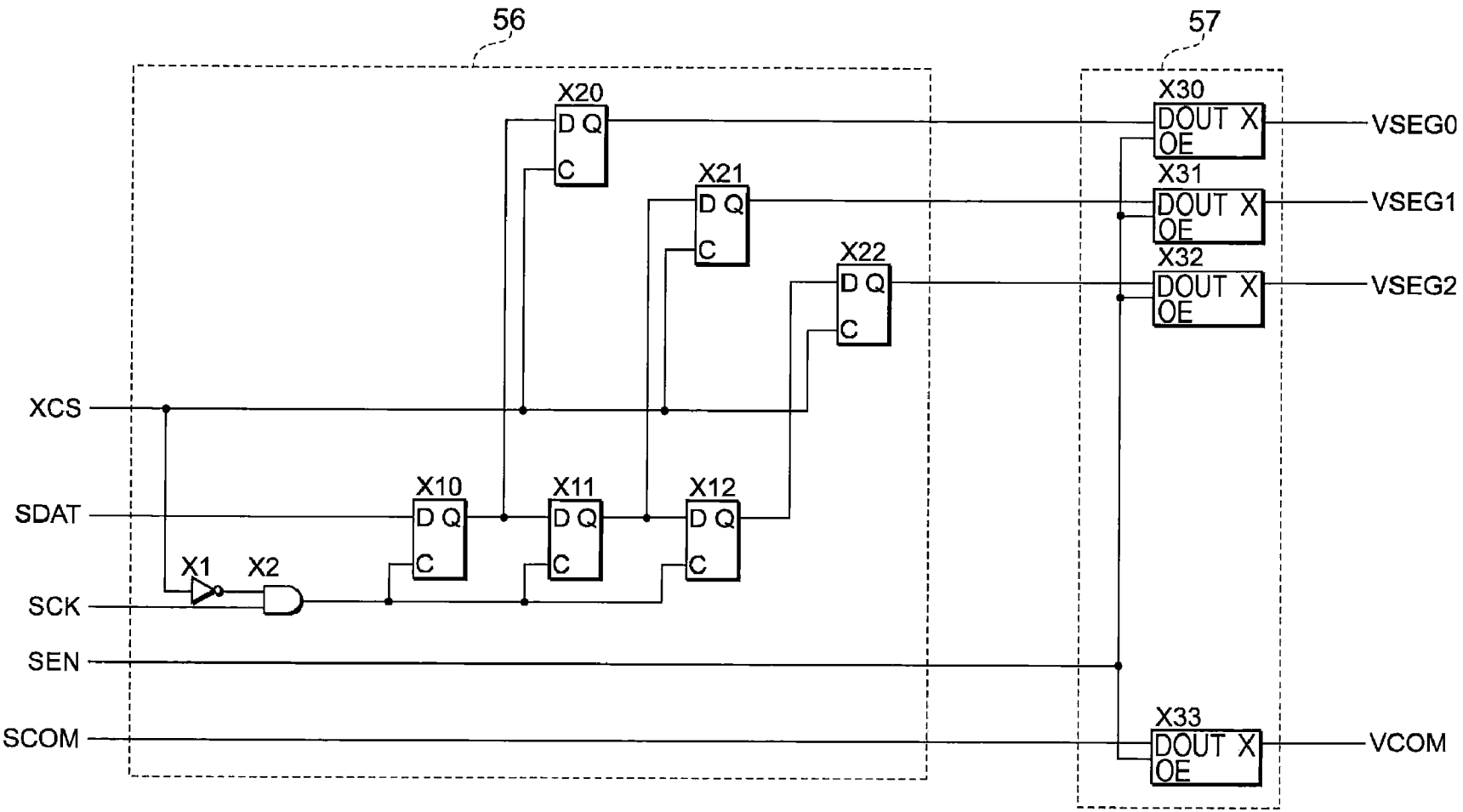
FIG. 10 is a view explaining a second embodiment.
Figure 11:
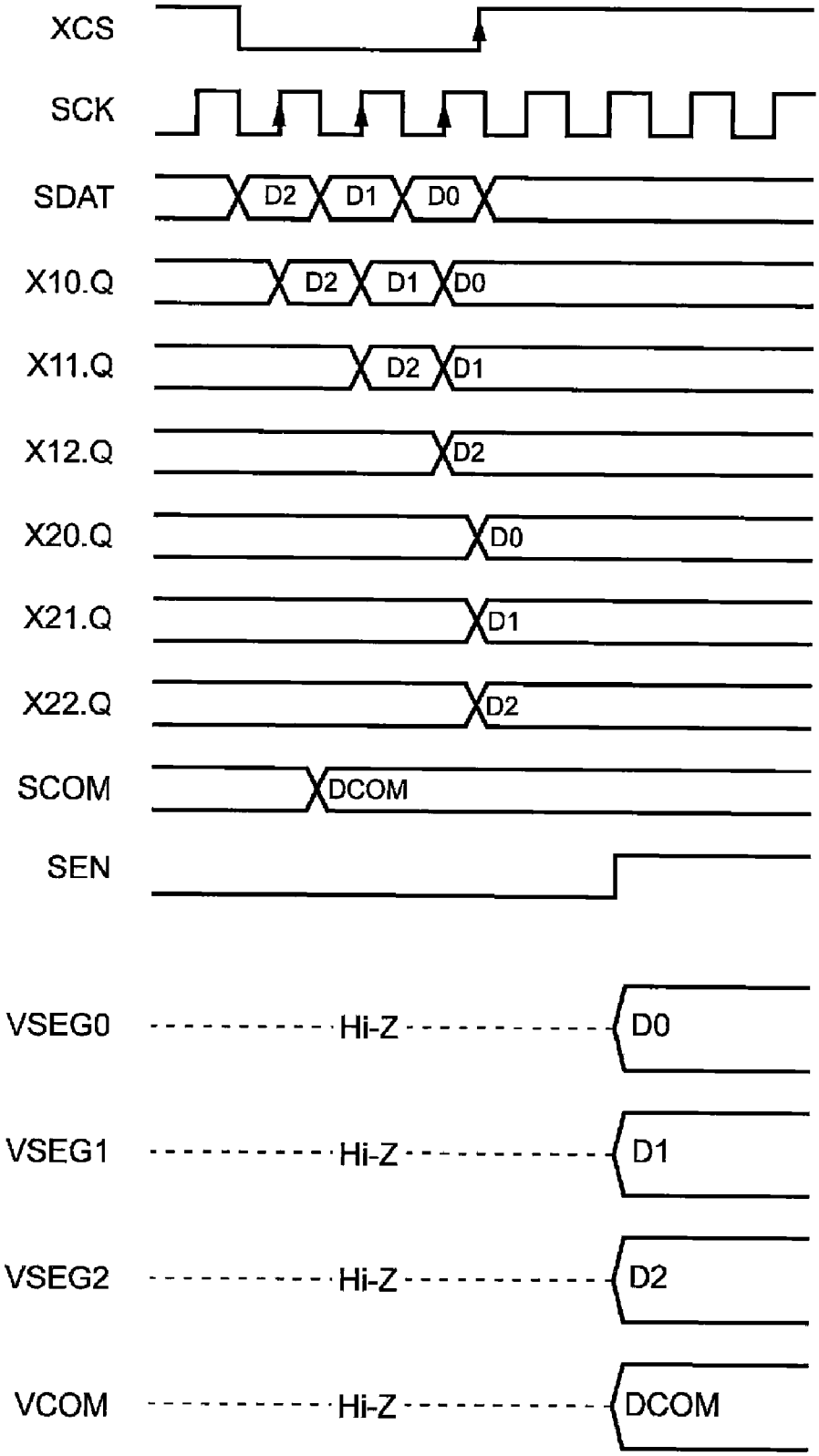
FIG. 11 is a view explaining an operation in the second embodiment.

FIGS. 10 and 11 are views illustrating a second embodiment of the invention. In FIG. 10, components corresponding to those in FIG. 7 are denoted by the same reference numerals, and detailed explanation thereof will be omitted.

As shown in FIG. 10, in the present embodiment, a configuration is used in which an SCOM signal is directly input to a ternary output circuit X23. For this reason, an input interface unit 56 includes logic gates X1 and X2, shift registers X10 to X12, and latches X20 to X22, but the latch X23 (refer to FIG. 7) is not provided. The other configurations are the same as those in FIG. 7.

In the configuration described above, it is requested that an external computer keep track of a display state of each electrode so as to properly control the SCOM signal; however, since constraint due to the XCS signal is also eliminated, there is an advantage in that, for example, inversion of a voltage applied to a common electrode can be controlled at free timing.

FIG. 11 is a timing chart illustrating waveforms of signals used to explain an operation (until setting voltage data of each electrode) of the driving circuit 50 in the second embodiment described above. In the drawing, components corresponding to those in FIG. 8 are denoted by the same reference numerals.

Even in the second embodiment, in order to perform predetermined display, an external computer supplies to the driving device 50 a serial data SDAT signal associated with voltage data of each segment electrode and a common electrode, a data transmission clock XCS signal, and an XCS signal indicating an existence period of time of the serial data SDAT signal as a low level VSS. Furthermore, the external computer separately supplies an SCOM signal used to set a voltage of the common electrode.

During a period of time when the XCS signal is at a low level, an input terminal of an AND gate X2 is at a high level LVDD, and thus the transmission clock SCK signal is supplied to the shift registers X10 to X12. The serial data SDAT signal is supplied in synchronization with the transmission clock SCK signal. Each of the D flip-flops X10 to X12 sequentially shifts serial data of the SDAT signal by enabling a D input at a rising edge of the SCK signal. In the example shown in the drawing, an explanation is made by using three data, that is, voltage data D0 to D2 of segment electrodes, for the convenience of explanation. Moreover, the voltage data DCOM of the common electrode is supplied separately from the serial data (SDAT signal) by using the SCOM signal. In addition, in the case when the number of segment electrodes is 79, shift registers corresponding to seventy-nine stages are provided, and voltage data D0 to D78 of segment electrodes are supplied.

When all serial data of the SDAT signal is transmitted and is then held in the shift registers X10 to X12, the XCS signal changes to a high level LVDD. Accordingly, Q outputs of the shift registers X10 to X12 are supplied to the latches X20 to X22, respectively, such that the voltage data D0 to D2 of the electrodes is held. Q outputs of the latches X20 to X22 are supplied to DOUT input terminals of the ternary output circuits X30 to X32, respectively.

On the other hand, unlike the first embodiment, the voltage data of the SCOM signal is directly input to the DOUT input terminal of the ternary output circuit X33.

Then, when the SEN signal supplied from the external computer changes to the high level LVDD that commands generation of an electrode voltage, the SEN signal serves as an OE (output enable) signal to activate each of the ternary output circuits X30 to X33. Thus, the ternary output circuits X30 to X33 respectively supply, to the electrodes VSEG0 to VSEG2 and VCOM, the voltage level HVDD or VSS corresponding to the Q outputs D0 to D2 of the latches X20 to X22 and the voltage level of the SCOM signal under a high impedance state.

As described above, the voltage setting with respect to each electrode is made. Further, in the circuit shown in FIG. 10, it is possible to set a voltage applied to the common electrode to HVDD or VSS by setting a voltage level of the SCOM signal to LVDD or VSS, without changing or regenerating a set voltage of each segment electrode.

Furthermore, in the embodiment described above, it has been described about the case in which an electrophoretic display panel is used as a display device of a watch; however, the invention is not limited thereto. For example, the plurality of segment electrodes described above may be a group of pixel electrodes that are arranged in a two-dimensional manner (in a matrix). Thus, the electrophoretic display panel may be used as an image display device that displays a character or an image (still image or moving picture) of an electronic book or a portable apparatus. In addition, in the case of intending to increase the response speed of display by applying a plurality of pulse voltages to the common electrode, the data processing burden of a computer of an electronic book or a portable apparatus can be alleviated.

As described above, according to the embodiments of the invention, in a driving device of an electrophoretic display panel, the configuration is used in which voltage data of each electrode supplied as serial data is supplied separately from voltage data of a common electrode. Accordingly, it is possible to change a voltage of the common electrode without retransmitting the voltage data of each electrode. As a result, for example, it becomes possible to shorten the movement time of electrophoretic particles, which makes it possible to improve display responsiveness of the electrophoretic display panel.

What is claimed is:

1. A driving device of an electrophoretic display panel having a common electrode and a plurality of divided electrodes disposed opposite to the common electrode, comprising:

a first driving circuit that outputs a plurality of voltages corresponding to a plurality of voltage data supplied as a series of data and supplies the plurality of voltages to the plurality of divided electrodes; and a second driving circuit that outputs a voltage corresponding to supplied data and supplies the voltage to the common electrode.

2. The driving device of the electrophoretic display panel according to claim 1, wherein the first driving circuit includes a series-to-parallel data conversion circuit serving to convert supplied serial data to parallel data and a plurality of voltage output circuits serving to generate voltages of levels corresponding to a plurality of data converted to the parallel data, and the second driving circuit includes a voltage output circuit serving to generate a voltage of a level corresponding to supplied data.

3. The driving device of the electrophoretic display panel according to claim 1, wherein the divided electrodes are segment electrodes used to display all or a part of display pattern or pixel electrodes arranged in a two-dimensional manner.

4. The driving device of the electrophoretic display panel according to claim 1, wherein the second driving circuit inverts a voltage applied to the common electrode in correspondence with the supplied data a plural number of times.

5. The driving device of the electrophoretic display panel according to claim 2, wherein the series-to-parallel data conversion circuit includes a shift register stage and a latch stage.

6. The driving device of the electrophoretic display panel according to claim 2, wherein the voltage output circuit is a ternary output circuit that outputs one of high impedance, high voltage level, and low voltage level in response to an input.

7. A driving method of an electrophoretic display panel having a common electrode and a plurality of divided electrodes disposed opposite to the common electrode, comprising:

outputting a plurality of voltages corresponding to a plurality of voltage data supplied as a series of data and supplying the plurality of voltages to the plurality of divided electrodes; and outputting a voltage corresponding to supplied data and supplying the voltage to the common electrode.

* * * * *